US008083696B2

(12) United States Patent
Vandenbelt et al.

(10) Patent No.: US 8,083,696 B2
(45) Date of Patent: Dec. 27, 2011

(54) LIGHT AND MASSAGE MULTI-THERAPY HAIRBRUSH

(75) Inventors: Rudy A. Vandenbelt, Ottawa (CA); Troy Gene Anderson, Marblehead, MA (US); Bi-Chieh Lino, Taoyuan (TW)

(73) Assignee: Headwaters R+D Inc, Ottawa (CA)

( * ) Notice: Subject to any disclaimer, the term of this patent is extended or adjusted under 35 U.S.C. 154(b) by 957 days.

(21) Appl. No.: 12/048,496

(22) Filed: Mar. 14, 2008

(65) Prior Publication Data

US 2009/0234253 A1 Sep. 17, 2009

(51) Int. Cl.
*A61H 1/00* (2006.01)

(52) U.S. Cl. ..... 601/15; 601/46

(58) Field of Classification Search ..... 601/15, 601/46, 136–137, 36, DIG. 14, DIG. 15; 15/167.1, 185–188, 207.2
See application file for complete search history.

(56) References Cited

U.S. PATENT DOCUMENTS

| | | | | |
|---|---|---|---|---|
| 3,084,700 | A | 4/1963 | Fischer et al. | |
| 3,517,235 | A | 6/1970 | Flowers et al. | |
| 4,930,504 | A | 6/1990 | Diamantopoulos et al. | |
| 5,511,270 | A | 4/1996 | Eliachar et al. | |
| 6,283,930 | B1 * | 9/2001 | Purvis et al. | 601/137 |
| 6,675,425 | B1 | 1/2004 | Iimura | |
| 7,503,093 | B2 * | 3/2009 | Weihrauch | 15/187 |
| 2002/0153020 | A1 | 10/2002 | Fiore | |
| 2004/0199227 | A1 | 10/2004 | Altshuler et al. | |
| 2005/0209538 | A1 | 9/2005 | Lev et al. | |
| 2006/0178714 | A1 | 8/2006 | Carullo, Jr. et al. | |

FOREIGN PATENT DOCUMENTS

EP 1666016 A1 6/2006

* cited by examiner

*Primary Examiner* — Michael A. Brown
(74) *Attorney, Agent, or Firm* — Albert Peter Durigon

(57) ABSTRACT

A hairbrush includes a control panel, an interior vibratory element for providing massage therapy and a plurality of LEDs carried by the brush head for providing light therapy at a preselected wavelength selected to be of benefit to the hair and/or scalp. In response to user control input mode selection, the light and massage multi-therapy hairbrush selectively provides phototherapy, massage therapy, and combined massage and phototherapies.

9 Claims, 5 Drawing Sheets

LIGHT AND MASSAGE MULTI-THERAPY HAIRBRUSH

FIELD OF THE INVENTION

This invention is drawn to the field of brushes, and more particularly, to a novel light and massage multi-therapy hair brush.

BACKGROUND OF THE INVENTION

It is known that hair and/or the scalp may be subjected to different treatments to benefit the hair and/or scalp. The benefit of head massage, of course, has long been recognized. Phototherapy is an emerging treatment modality that is known or believed to desirably affect, among other hair and/or scalp characteristics, hair volume, texture, color, and quality; and that is known or believed to prevent hair loss, promote hair vitality and/or growth, and to promote cell growth or health among other hair and/or scalp benefits.

Handheld phototherapy devices heretofore, such as the Leimo Personal Hair Laser or the HairMax Laser Comb, have been limited to combs the comb fingers of which served as positioning elements to sequentially space the comb correctly to the scalp as it was moved through the hair to confront different parts of the scalp during a phototherapeutic treatment session. Any massage action provided by the heretofore known phototherapeutic combs was manually provided by so manipulating the comb as to cause the comb fingers to be moved into massaging scalp contact in a manner corresponding to the controlling movements manually imparted to the comb. To impart the requisite manual motions to provide phototherapy or manual massage, however, a degree of learning and skill was required which constricted their utility. Moreover, the heretofore known phototherapeutic combs have been comparatively expensive, on the order of hundreds if not thousands of dollars, which has restricted their utility to a comparatively few users.

There is thus a need for a light and massage multi-therapy hairbrush that is comparatively low in cost and easy to use in light and/or massage therapy modes.

SUMMARY OF THE INVENTION

Accordingly, is a principal object of the principal invention to provide a light and massage multi-therapy hairbrush.

It is a related object of the present invention to provide a light and massage multi-therapy hairbrush that is comparatively low in cost and so readily available to a comparatively large number of users.

It is a further object of the present invention to provide a light and massage multi-therapy hairbrush that is as easy to use in its light and/or massage therapy modes as during normal use for grooming requiring little if no learning or special skill.

In accordance with these and other objects of the present invention, a light and massage multi-therapy hairbrush is disclosed that includes any brush head having bristles and bristle carrier suitable for use as an ordinary hairbrush.

A light therapy module including at least one light source is disclosed that is coupled to the brush head suitable for use as an ordinary hairbrush for irradiating the hair and scalp with light of wavelength and intensity selected to be good for and of benefit to the hair and/or scalp. In one presently preferred embodiment, a plurality of LEDs are arrayed in a ring and mounted peripherally about the brush head. In alternate disclosed embodiments, the LEDs may be coupled to bristle proximate or distal ends immediately or mediately. In alternate disclosed embodiments, one or more LEDs may be mounted onto the exposed face of a bristle carrier or under a bristle carrier transparent to the LEDs. Preferably, 660 nm LEDs are employed although other coherent and/or incoherent light sources at the same or other wavelengths good for the hair and/or scalp may be employed.

A massage therapy module including a motor driven vibratory element is disclosed that is coupled to the brush head for imparting therapeutic mechanical wave energy to the scalp.

A control panel coupled to the light and massage therapy modules is disclosed for controllably actuating the light source and the motor driven vibratory element to selectively provide light therapy, massage therapy, and light and massage therapy in response to user input control selection.

In one presently preferred embodiment, the light and massage therapy modules are battery-powered. In alternative embodiments, AC power may be employed.

BRIEF DESCRIPTION OF THE DRAWING

These and other benefits, advantageous features and inventive aspects of the present invention will become apparent as the invention becomes better understood by referring to the following solely exemplary detailed description of the presently preferred embodiments, and to the drawings, wherein.

DETAILED DESCRIPTION OF THE PRESENTLY PREFERRED EMBODIMENTS

Figure 1:
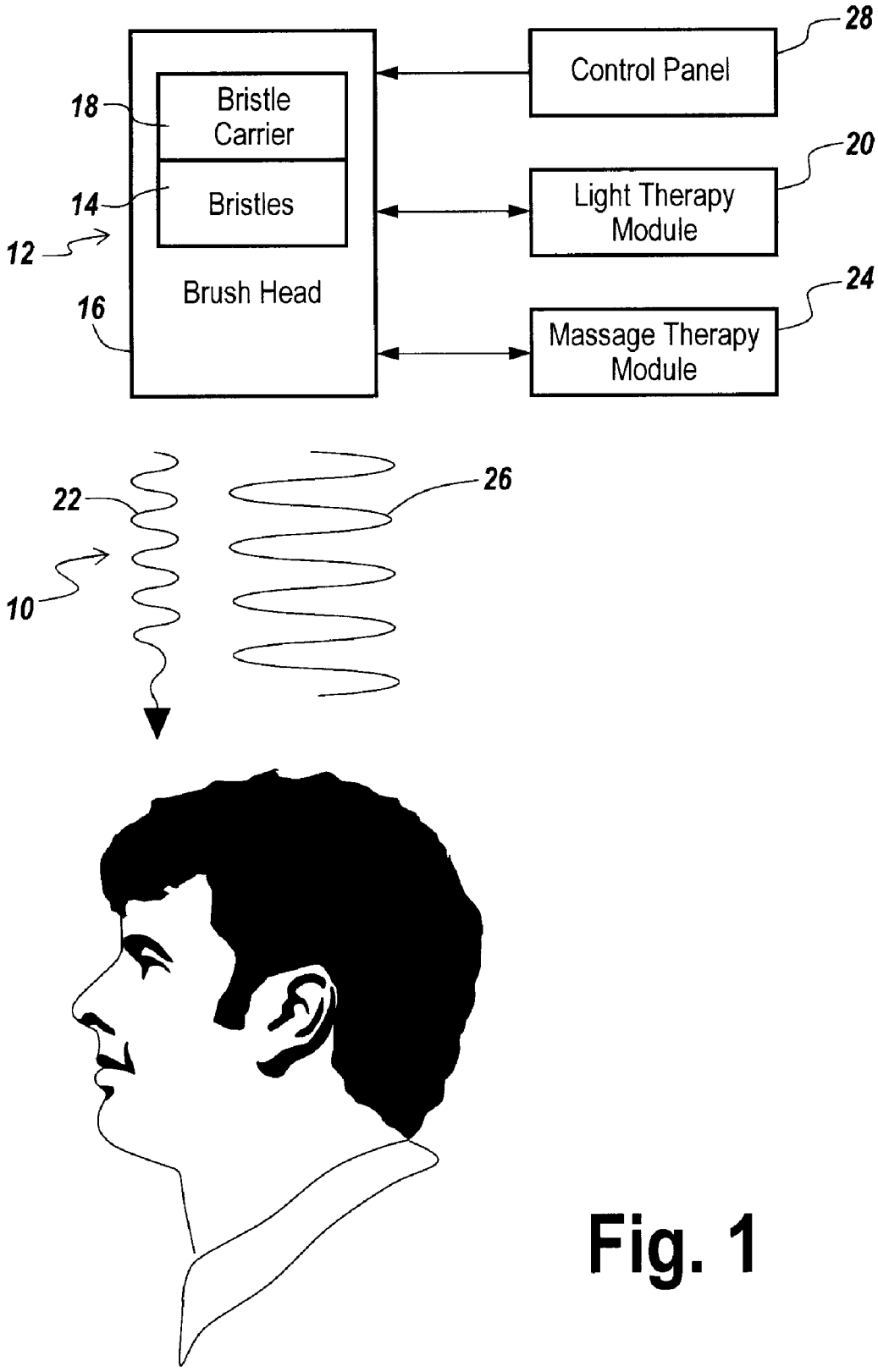
FIG. 1 is a block diagram useful in explaining the principles of the novel light and massage multi-therapy hairbrush of the present invention.

Referring now to FIG. 1, generally designated at 10 is a block diagram of one presently preferred embodiment of a light and massage multi-therapy hairbrush in accord with the present invention. The light and massage multi-therapy hairbrush 10 includes a hairbrush generally designated 12 that is used in normal manner to groom the hair. The hairbrush 12 includes bristles 14 mounted to a brush head 16 via a bristle carrier 18. The bristles 14 and brush head 16 may be any suitable natural or synthetic material. The bristle carrier 18 may be any suitable means or member for mounting the bristles 14 to the brush head 16.

A light therapy module 20 is coupled to the hairbrush 12. The light therapy module 20 is selectively operable to provide light energy 22 at a wavelength and intensity to provide phototherapy to the hair and/or scalp. Preferably the light energy 22 is provided by any suitable light source including a 660 nm output such as an LED although other incoherent or coherent light sources at different wavelengths could be employed.

A massage therapy module 24 is coupled to the hairbrush 12. The massage therapy module 24 is selectively operable to provide mechanical wave energy 26 to the hair and/or scalp. The mechanical wave energy 26 promotes blood circulation and effectively stimulates hair growth. Preferably the mechanical wave energy 26 is provided by an electric motor although other sources of vibration could be employed.

A control panel 28 is coupled to the hairbrush 12, light therapy module 20 and massage therapy module 24. The control panel may be any suitable switch or other input means for selectively causing the light therapy module 20 to provide phototherapy, to cause the massage therapy module 24 to provide massage therapy and/or to cause the light therapy module 20 to provide phototherapy while the massage therapy module 24 simultaneously provides massage therapy. In any light therapy, massage therapy or combined light and massage therapy modes, the hairbrush 12 may be used in the normal manner for personal grooming.

Figure 2:
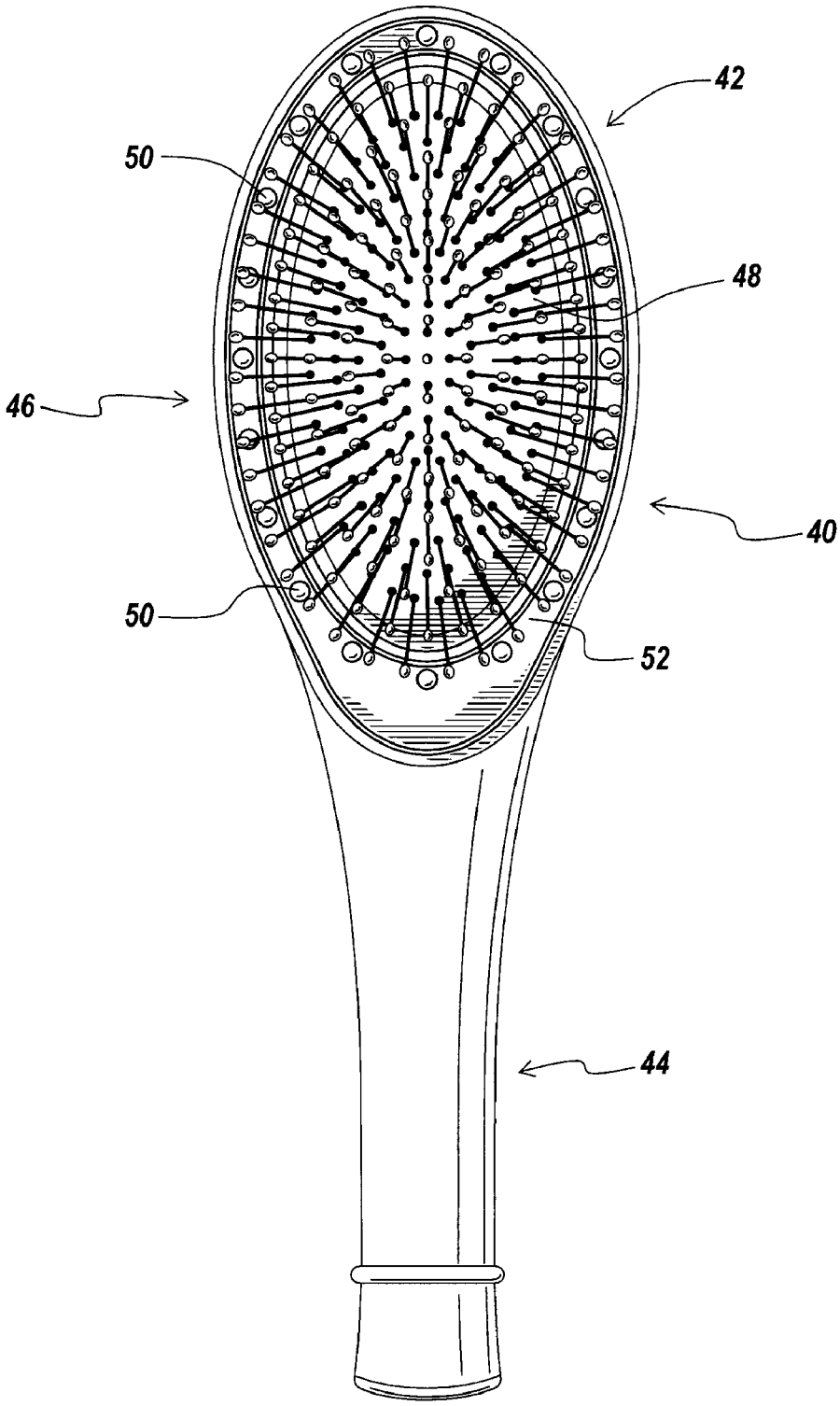
FIGS. 2 and 3 respectively are top and bottom plan views of one presently preferred embodiment of a light and massage multi-therapy hairbrush in accord with the present invention.
Figure 3:
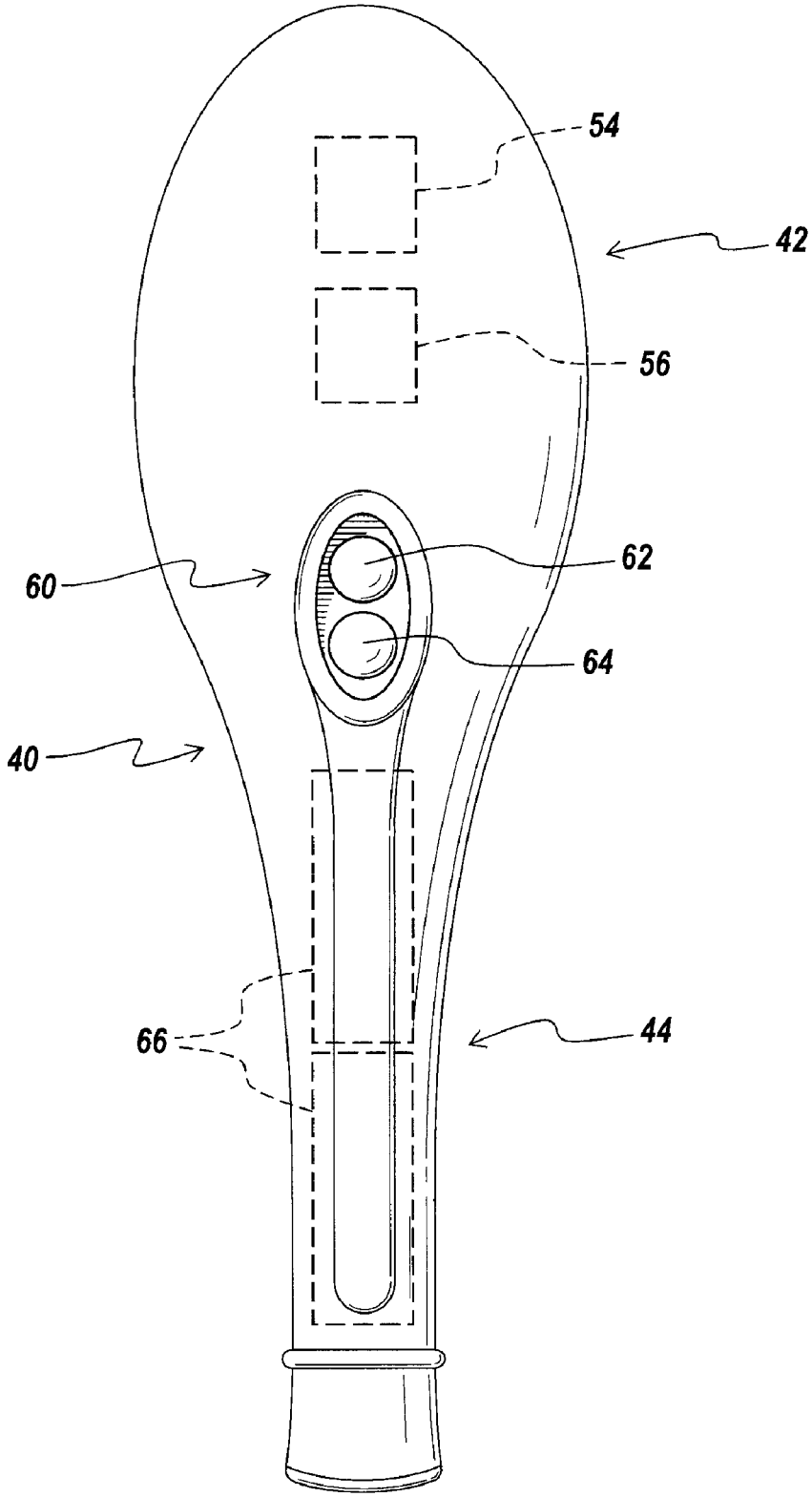

Referring now to FIGS. 2 and 3, generally designated at 40 is one presently preferred embodiment of the light and massage multi-therapy hairbrush in accord with the present invention. The multi-therapy hairbrush 40 includes a brush head generally designated 42 and elongated handle generally designated 44. A plurality of bristles generally designated 46 extend through a resilient bristle carrier 48 that is mounted to the brush head 42.

A plurality of 660 nm LEDs 50 are individually mounted to and peripherally arrayed about the brush head 42. A lens ring 52 is mounted to the brush head 42 over the LEDs 50. The lens ring 52 provides a lens action to focus the light emitted from each of the LEDs 50 to promote phototherapeutic effectiveness. As will be appreciated, the wavelength and intensity of the light energy thereby imparted in light therapy mode benefits the hair and/or scalp and may be used during normal grooming use of the hairbrush.

An electric motor having a weight eccentrically mounted to its shaft is mounted interior to the brush head 42 as schematically illustrated by dashed box 54. The vibrations thereby produced mechanically couple to the body of the brush head 42 through the bristle carrier 48 and individually into the bristles 46. The vibrations thereby imparted in massage therapy mode improve circulation and may be used during normal grooming use of the hairbrush.

A printed circuit board 56 is mounted interior to the brush head 42 as schematically illustrated by dashed box 56. The printed circuit board includes drivers for the LEDs 50, motor control, switching and other circuitry to operate the LEDs and motor driven vibratory element. The control panel 60 includes a switch 62 coupled to the printed circuit board 56 for actuating the LEDs and a switch 64 coupled to the printed circuit board 56 for actuating the motor 54. Batteries shown dashed at 66 removably mounted inside the handle 44 are operatively connected to the printed circuit board 56 and control panel 60. The batteries may be rechargeable and an AC adapter and plug end, not shown, may be employed.

By controlled depression of the buttons 62, 64, phototherapy, massage therapy and combination phototherapy and massage therapy modes of the multi-therapy hairbrush 40 may be selected. In any mode selected, the hairbrush 40 may be used for normal grooming use.

Figure 4:
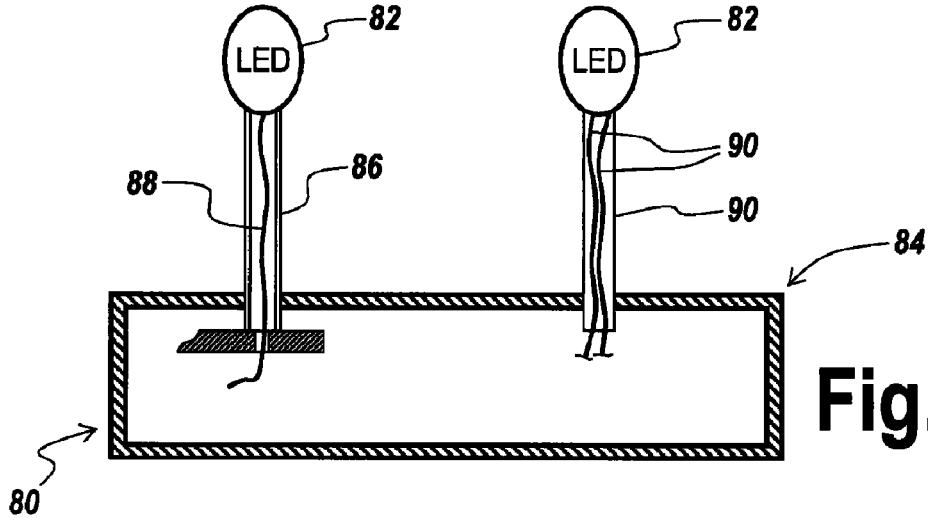
FIG. 4 is a pictorial view of an alternate embodiment of a light therapy module of the light and massage multi-therapy hairbrush of the present invention.

With reference to FIGS. 4-8, alternative light therapy module embodiments will now be described. In FIG. 4, LEDs 82 carried at the proximate end of the bristles 86, 92 are mounted to the brush head 84 of light therapy module 80. Electrical contact to the LEDs 82 in one embodiment is made to one pole through the shaft of hollow conductive bristle 86 and to the other pole via wire 88 threaded through the hollow bristle 86. Alternately, electrical contact to LEDs 82 is made by threading two wires through the hollow bristles 92.

Figure 5:
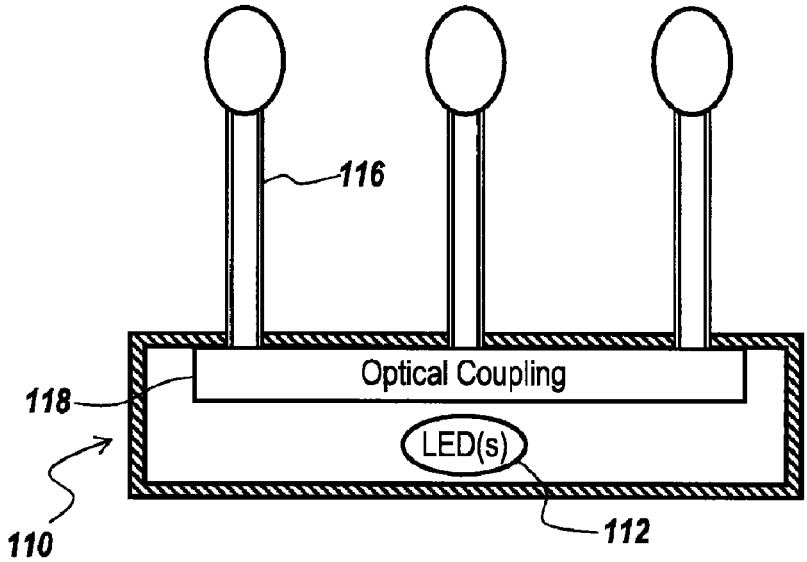
FIG. 5 is a pictorial view of an alternate light therapy module embodiment of the light and massage multi-therapy hairbrush of the present invention.

In FIG. 5, one or more LEDs 112 are carried inside the brush head 114 of light therapy module 110. The bristles 116 mounted to the brush head 114 are of any material that is transparent to the wavelength of the light of the LEDs 112. Optical coupling 118 is provided between the LEDs 112 and the transparent bristles 116. The optical coupling 118 may be optical fibers individually associated with corresponding LEDs, plural optical fibers each for several transparent bristles associated with individual LEDs or another optical element providing collective coupling between multiple transparent bristles and one or more LEDs.

Figure 6:
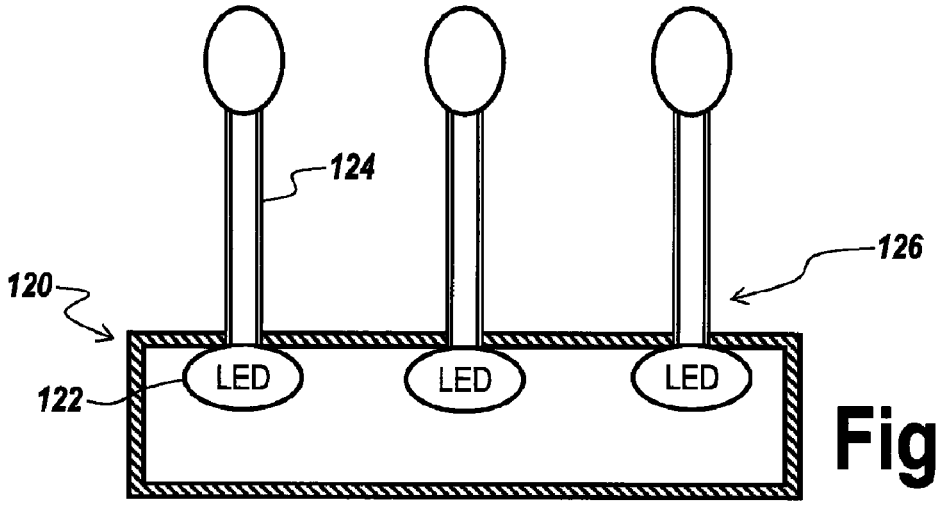
FIG. 6 is a pictorial view of another light therapy module of the light and massage multi-therapy hairbrush of the present invention.

In FIG. 6, LEDs 122 carried at the distal ends of the bristles 124 are mounted to the brush head 126 of light therapy module 120. The bristles 124 are transparent to the wavelength of light output by the LEDs 122.

Figure 7:
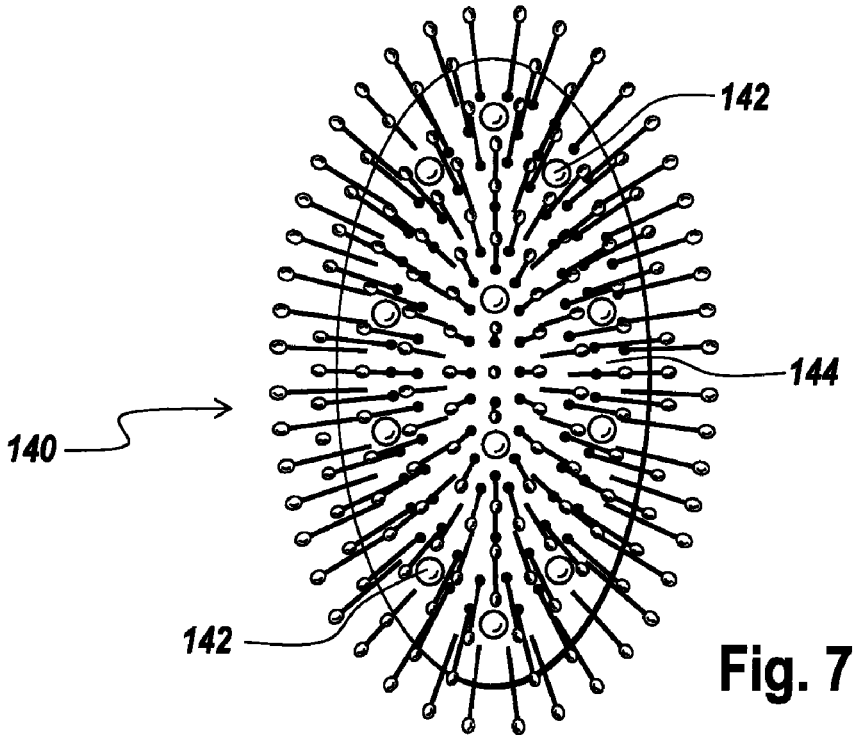
FIG. 7 is a top plan of an alternate light therapy module embodiment of the light and massage multi-therapy hairbrush of the present invention.

In FIG. 7, LEDs 142 are mounted to the hair and scalp confronting face of the bristle carrier 144 of the light therapy module 140.

Figure 8:
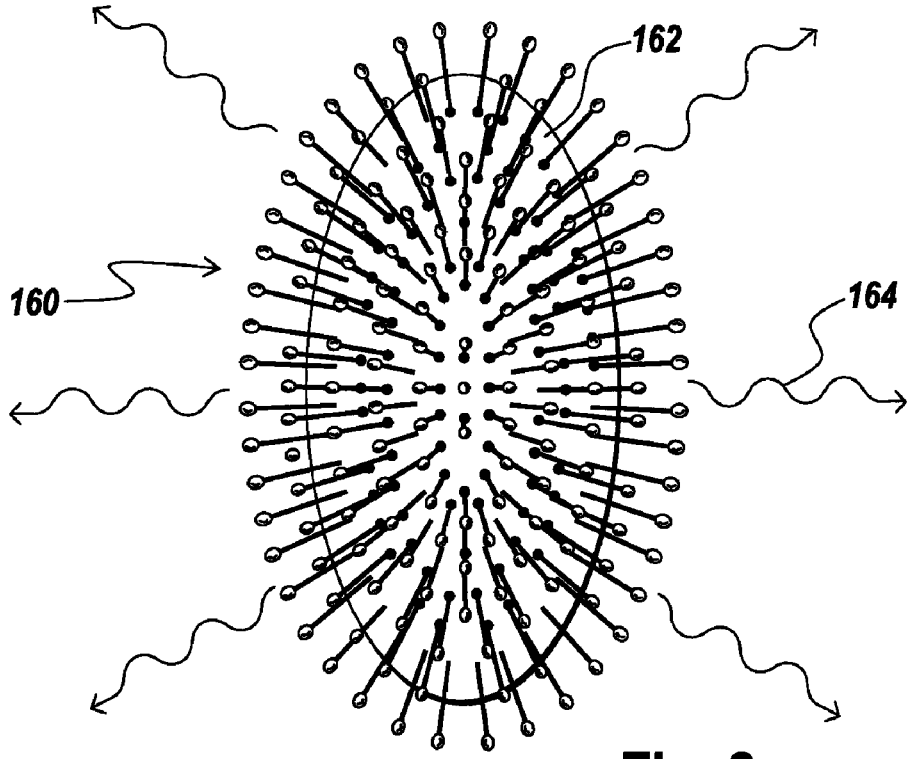
FIG. 8 is a top plan view of an alternate light therapy module of the light and massage multi-therapy hairbrush of the present invention.

In FIG. 8, the bristle carrier 162 is of a material transparent to the wavelength of the light emitted and LEDs, not shown, are mounted under the bristle carrier 162 within the brush head of the light therapy module 160. The bristle carrier 162 glows as schematically illustrated by arrows 164 in light therapy mode.

Many modifications of the presently disclosed invention will become apparent to those of skill in the art without departing from the inventive concepts.

What is claimed is:

1. A light and massage multi-therapy hairbrush providing light and/or massage therapy modes that may be used during normal grooming use of the hairbrush, comprising:

a brush head having bristles and bristle carrier suitable for use as an ordinary hairbrush;

a light therapy module coupled to the brush head including at least one light source for irradiating the hair and scalp with light of wavelength and intensity selected to be good for and of benefit to the hair and/or scalp;

a massage therapy module including a motor driven vibratory element coupled to the brush head for imparting therapeutic mechanical wave energy to the hair and scalp; and a control panel coupled to the light and massage therapy modules for controllably actuating the light source and the motor driven vibratory element to selectively provide light therapy, massage therapy, and light and massage therapy in response to user input control selection that may be used in any of its modes during normal grooming use as a hairbrush;

wherein the light therapy module includes a plurality of LEDs arrayed in a ring and mounted peripherally about the brush head;

further including a lens ring positioned over the plurality of LEDs arrayed in a ring and mounted to the brush head.

2. The light and massage multi-therapy hairbrush of claim 1, wherein the light therapy module includes 660 nm LEDs.

3. The light and massage multi-therapy hairbrush of claim 1, wherein said control panel includes a switch for selecting phototherapy and/or massage therapy modal use.

4. A light and massage multi-therapy hairbrush providing light and/or massage therapy modes that may be used during normal grooming use of the hairbrush, comprising:

a brush head having bristles and bristle carrier suitable for use as an ordinary hairbrush;

a light therapy module coupled to the brush head including at least one light source for irradiating the hair and scalp with light of wavelength and intensity selected to be good for and of benefit to the hair and/or scalp;

a massage therapy module including a motor driven vibratory element coupled to the brush head for imparting therapeutic mechanical wave energy to the hair and scalp; and a control panel coupled to the light and massage therapy modules for controllably actuating the light source and the motor driven vibratory element to selectively provide light therapy, massage therapy, and light and massage therapy in response to user input control selection that may be used in any of its modes during normal grooming use as a hairbrush;

wherein the light therapy module includes LEDs individually coupled to corresponding bristle proximate ends.

5. The light and massage multi-therapy hairbrush of claim 4, wherein the bristles are hollow, electrically conductive bristles.

6. A light and massage multi-therapy hairbrush providing light and/or massage therapy modes that may be used during normal grooming use of the hairbrush, comprising:

a brush head having bristles and bristle carrier suitable for use as an ordinary hairbrush;

a light therapy module coupled to the brush head including at least one light source for irradiating the hair and scalp with light of wavelength and intensity selected to be good for and of benefit to the hair and/or scalp;

a massage therapy module including a motor driven vibratory element coupled to the brush head for imparting therapeutic mechanical wave energy to the hair and scalp; and a control panel coupled to the light and massage therapy modules for controllably actuating the light source and the motor driven vibratory element to selectively provide light therapy, massage therapy, and light and massage therapy in response to user input control selection that may be used in any of its modes during normal grooming use as a hairbrush;

wherein the light therapy module includes LEDs coupled to bristle distal ends.

7. The light and massage multi-therapy hairbrush of claim 6, wherein the bristles are materially transmissive of the wavelength of the LEDs.

8. A light and massage multi-therapy hairbrush providing light and/or massage therapy modes that may be used during normal grooming use of the hairbrush, comprising:

a brush head having bristles and bristle carrier suitable for use as an ordinary hairbrush;

a light therapy module coupled to the brush head including at least one light source for irradiating the hair and scalp with light of wavelength and intensity selected to be good for and of benefit to the hair and/or scalp;

a massage therapy module including a motor driven vibratory element coupled to the brush head for imparting therapeutic mechanical wave energy to the hair and scalp; and a control panel coupled to the light and massage therapy modules for controllably actuating the light source and the motor driven vibratory element to selectively provide light therapy, massage therapy, and light and massage therapy in response to user input control selection that may be used in any of its modes during normal grooming use as a hairbrush;

wherein the light therapy module includes LEDs mounted to the brush head under a bristle carrier transparent to the LEDs.

9. A light and massage multi-therapy hairbrush providing light and/or massage therapy modes that may be used during normal grooming use of the hairbrush, comprising:

a brush head having bristles and bristle carrier suitable for use as an ordinary hairbrush;

a light therapy module coupled to the brush head including at least one light source for irradiating the hair and scalp with light of wavelength and intensity selected to be good for and of benefit to the hair and/or scalp;

a massage therapy module including a motor driven vibratory element coupled to the brush head for imparting therapeutic mechanical wave energy to the hair and scalp; and a control panel coupled to the light and massage therapy modules for controllably actuating the light source and the motor driven vibratory element to selectively provide light therapy, massage therapy, and light and massage therapy in response to user input control selection that may be used in any of its modes during normal grooming use as a hairbrush;

wherein said massage therapy module includes a weight mounted eccentrically to said motor to produce vibrations.

* * * * *